US010968532B2

(12) United States Patent
Hoffman, Jr. et al.

(10) Patent No.: US 10,968,532 B2
(45) Date of Patent: Apr. 6, 2021

(54) METHOD FOR ELECTROLYTIC CLEANING OF ALUMINUM

(71) Applicant: H&H Research & Development, LLC, Harrisburg, PA (US)

(72) Inventors: John E. Hoffman, Jr., Hummelstown, PA (US); Richard A. Hoffman, Sr., Harrisburg, PA (US)

(73) Assignee: H&H Research & Development, LLC, Harrisburg, PA (US)

( * ) Notice: Subject to any disclaimer, the term of this patent is extended or adjusted under 35 U.S.C. 154(b) by 0 days.

(21) Appl. No.: 15/985,982

(22) Filed: May 22, 2018

(65) Prior Publication Data

US 2018/0266010 A1 Sep. 20, 2018

Related U.S. Application Data

(63) Continuation-in-part of application No. 15/902,234, filed on Feb. 22, 2018, which is a continuation-in-part of application No. 15/364,859, filed on Nov. 30, 2016, now abandoned.

(60) Provisional application No. 62/509,406, filed on May 22, 2017.

(51) Int. Cl.
*C25F 1/00* (2006.01)
*C25F 7/00* (2006.01)

(52) U.S. Cl.
CPC . *C25F 1/00* (2013.01); *C25F 7/00* (2013.01)

(58) Field of Classification Search
CPC ..... C02F 1/00
See application file for complete search history.

(56) References Cited

U.S. PATENT DOCUMENTS

| | | | | |
|---|---|---|---|---|
| 3,951,827 | A * | 4/1976 | Burroughs | C02F 5/08 507/241 |
| 4,046,592 | A * | 9/1977 | Westervelt | C25F 1/04 134/1 |
| 4,457,322 | A | 6/1984 | Rubin et al. | |
| 4,493,756 | A * | 1/1985 | Degen | C25F 1/00 205/712 |
| 5,102,508 | A | 4/1992 | Bartkwoski et al. | |
| 6,203,691 | B1 | 3/2001 | Hoffman, Jr. et al. | |
| 6,264,823 | B1 * | 7/2001 | Hoffman, Jr. | C25F 1/00 204/242 |
| 2016/0002807 | A1 * | 1/2016 | Taira | C21D 9/46 148/241 |
| 2017/0081776 | A1 * | 3/2017 | Hoffman, Jr. | B22C 1/02 |

(Continued)

OTHER PUBLICATIONS

Nelson, Removing Rust with Your Battery Charger (electrolysis method).*

(Continued)

*Primary Examiner* — Salil Jain
(74) *Attorney, Agent, or Firm* — Hooker & Habib, P.C.

(57) ABSTRACT

A method for cleaning a surface of an aluminum or aluminum alloy body by immersing the surface in a basic aqueous electrolyte formed essentially from dissolved trisodium phosphate, flowing DC current through the electrolyte and the body for cleaning, and then removing the body from the electrolyte. An additional cleaning step, which may include ultrasonic cleaning, may be performed to remove loose matter adhering to the body after the electrolytic cleaning.

18 Claims, 2 Drawing Sheets

(56) References Cited

U.S. PATENT DOCUMENTS

2018/0179659 A1* 6/2018 Hoffman, Jr. ..... C25F 7/00

OTHER PUBLICATIONS

Gilbert, "Cleaning Aluminum Siding", Jul. 18, 2002, https://web.archive.org/web/20161027164219/https://mrhardware.com/articles-and-videos/cleaning-aluminum-siding/, retrieved Oct. 27, 2016, 1 page.

American Machinest, "Tips on ultrasonic cleaning", Feb. 16, 2017, https://web.archive.org/web/20170216235336/http://www.americanmachinest.com/shop-operations/tips-ultrasonic-cleaning; retrieved Jul. 13, 2018, 3 pages.

US Patent and Trademark Office, International Search Report, corresponding PCT/US18/33822, dated Jul. 31, 2018, 14 pages.

* cited by examiner

METHOD FOR ELECTROLYTIC CLEANING OF ALUMINUM

RELATED APPLICATION

This application claims priority to and the benefit of: US provisional patent application 62/509,406 "Method for Electrolytic Cleaning" filed May 22, 2017, and is a continuation-in-part of and claims the benefit of U.S. patent application Ser. No. 15/902,234 "Method for Cleaning Aluminum or Aluminum Alloy Surfaces" filed Feb. 22, 2018, which in turn is a continuation-in-part of U.S. patent application Ser. No. 15/364,859 titled "Method for Cleaning Metal or Metal Alloy Surfaces" filed Nov. 30, 2016, which three priority applications are each incorporated by reference as if fully set forth herein.

FIELD OF THE DISCLOSURE

The disclosure relates generally to methods for cleaning aluminum and aluminum alloy bodies, and in particular, electrolytic cleaning of aluminum and aluminum bodies.

BACKGROUND OF THE DISCLOSURE

Surfaces of aluminum bodies or components must be returned to a clean, bare surface for recycling and reuse ("aluminum" as used in this specification refers to aluminum and aluminum alloys).

Aluminum wheels of trucks and airplanes are exposed to brake dust, road grime, oil, and other surface contaminants or coatings that must be removed from the wheel before the wheel can be recycled and reused.

Aluminum wheels are conventionally cleaned for recycling by sanding the wheel surface that will be visible in use (typically only one side of the wheel). The production rate is low, and so the economics of recycling of aluminum wheels is often unfavorable. There is a limit to how many times a wheel can be sanded and still be fit for use, and so the number of times a sanded wheel can be recycled is limited.

Aluminum wheels may also be cleaned using an acid wash to remove surface contaminants. Care must be taken to prevent the acid from etching or pitting the aluminum. The acid must be carefully handled and safely disposed of.

There is a need for an improved method for cleaning aluminum bodies that does not remove aluminum, does not etch, pit, or stain the aluminum, and results in an aluminum having a commercially acceptable brightness after cleaning.

SUMMARY OF THE DISCLOSURE

Disclosed is a method for electrolytic cleaning of aluminum bodies that does not remove aluminum, does not etch, pit, or stain the aluminum, and results in the cleaned aluminum body having a commercially acceptable brightness after cleaning.

Electrolysis utilizes a liquid electrolyte that contains ions used to conduct electricity through the liquid. The electrolyte is formed by dissolving a solid in the liquid, the dissolved solid providing the ions present in the liquid.

In electrolytic cleaning of a body, an electrically-conductive body is immersed in or wetted by a liquid electrolyte. Electric current from a current source passes through the electrolyte and through the body to remove or loosen surface contaminants, coatings, and the like. An additional cleaning step may be performed to remove any material adhering to the body after removal of the body from the electrolyte.

The disclosed method for electrolytic cleaning of an aluminum body utilizes an electrolyte formed from a mixture of water and trisodium phosphate. The aluminum body is wetted by the electrolyte, electrical current is passed through the body for a length of time sufficient to adequately remove or loosen the surface contaminants, and the body is then removed from the electrolyte. If desired, an additional cleaning step can be performed after removal from the electrolyte to remove contaminants, coatings, or the like still adhering to the body.

The electrolyte in embodiments may have a pH of between 10 and 10.5 inclusive and be maintained at a temperature of between 150 degrees Fahrenheit and the boiling point of the electrolyte. The current may be a 1000 ampere DC current applied for five minutes.

The additional cleaning step may be ultrasonic cleaning of the body.

It has been found that electrolytic cleaning of aluminum truck wheels using the disclosed method provides for cleaned wheels having a commercially acceptable brightness for recycling, reuse, or resale.

Trisodium phosphate is the inorganic compound with the chemical formula Na3PO4. Trisodium phosphate is highly soluble in water, producing an alkaline solution.

Trisodium phosphate has been used conventionally as cleaning agent but not in forming an electrolyte for electrolysis. Trisodium phosphate was often found in consumer formulations of soaps and detergents. An aqueous solution of 1% trisodium phosphate can saponify grease and oils. Trisodium phosphate is not recommended for cleaning metals however because such use may cause metal staining.

The inventors have discovered the surprising result that using trisodium phosphate alone to form an aqueous electrolyte enables cleaning of aluminum bodies without staining the bodies and without harming the bodies. Trisodium phosphate is not normally used to form an electrolyte for conducting electrical current. Aluminum wheels cleaned using the disclosed method had no detectable loss of aluminum, did not stain, etch, or pit, and had a commercially acceptable surface brightness over the entire wheel surface.

The cleaning action provided by the disclosed trisodium phosphate electrolyte is a less aggressive cleaning action than that provided by the method disclosed in the priority '859 application. For example, the trisodium phosphate electrolyte is believed to be impractical for removing powder coating from aluminum metal wheels, yet cleans non-powder coated wheels about as effectively as the cleaning method disclosed in the priority '859 application. However, the disclosed method utilizing the TSP electrolyte provides bright wheels without the necessity of removing the film generated in the '859 application method.

Other objects and features of the disclosure will become apparent as the description proceeds.

DETAILED DESCRIPTION

Figure 1:
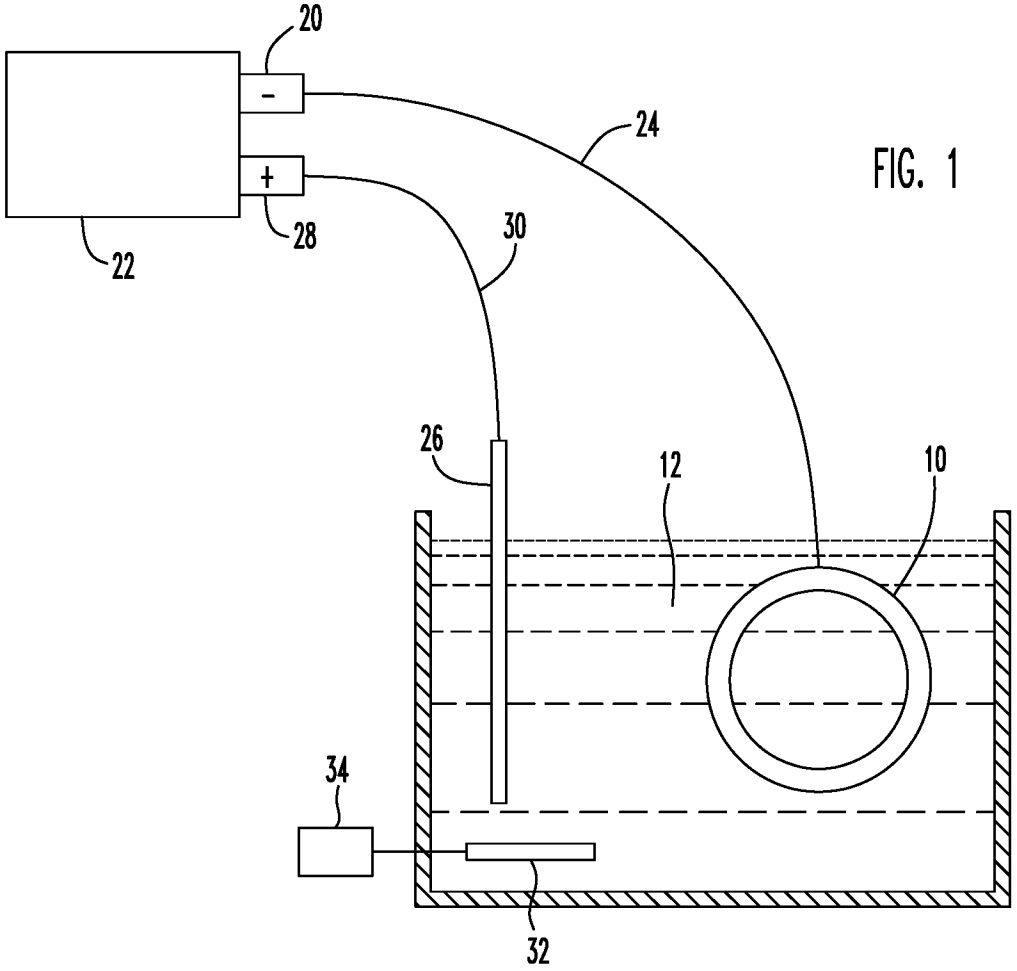
FIG. 1 is a schematic view of a metal alloy wheel immersed in an electrolyte for cleaning in accordance with an embodiment of the disclosed method of cleaning.
Figure 2:
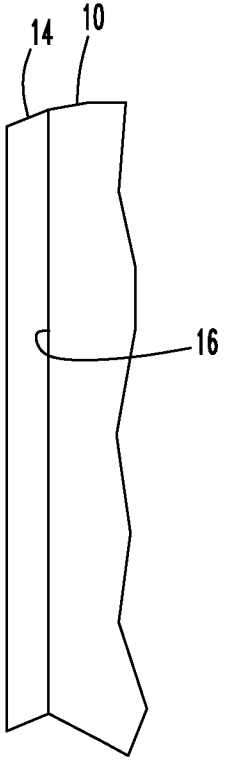
FIG. 2 is an enlarged view of a portion of the wheel shown in FIG. 1.

FIG. 1 illustrates a used truck or airplane wheel 10 totally immersed in an electrolyte 12 for cleaning in accordance with the disclosed method. The wheel 10 is a conventional aluminum wheel having an external surface 16. See FIG. 2. It is desired to remove surface contaminants 14 from the surface 16 to enable recycling and reuse of the wheel.

The wheel 10 is connected electrically in series to the negative terminal 20 of a DC current source 22 by a conductor 24. A steel or iron electrode 26 is also immersed in the electrolyte 12 and is connected in series to a positive terminal 28 of the current source 22 by a conductor 30. The wheel 10 and the electrode 26 are electrically connected by the electrolyte 12.

The electrolyte 12 in a first embodiment of the disclosed method is an aqueous electrolyte formed solely of water and trisodium phosphate (TSP). TSP can be obtained commercially from UNIVAR USA INC., 3075 Highland Pkwy Ste 200, Downers Grove, Ill.

Water and TSP are mixed together to form the basic electrolyte 12. The TSP in the illustrated embodiment is added to the water at a rate of 15 weight percent of TSP to the weight of water. Thus if there is 400 pounds of water, 60 pounds of TSP is added to the water to form the electrolyte.

The resulting electrolyte 12 that forms by mixing TSP and water is referred to as a "TSP electrolyte" herein. The TSP electrolyte is a basic electrolyte having a pH of 10.2 or so, or about 10. In possible embodiments of the disclosed method the TSP electrolyte may have a pH of between 10 and 10.5 inclusive.

The temperature of the TSP electrolyte 12 is maintained at between about 150 degrees Fahrenheit (66 degrees Celsius) and the boiling point of the electrolyte. Preferably the temperature of the TSP electrolyte is maintained at between 180 degrees Fahrenheit (82 degrees Celsius) and 190 degrees Fahrenheit (88 degrees Celsius) during cleaning. The output of a water heater 32 is automatically controlled by an automatic control system 34 to maintain the desired electrolyte temperature.

In the illustrated embodiment the wheel 10 is immersed into a 200 gallon bath of the TSP electrolyte 12.

After the wheel 10 is immersed in the TSP electrolyte 12, the DC current source 22 is energized. DC electrical current continuously flows through the electrolyte 12 and the wheel 10.

The current source 22 when energized flows a DC current of preferably between 500 amperes and 1250 amperes, and most preferably for wheels 10 a current of about 1000 amperes, through the wheel 10 continuously for five minutes.

The electrical circuit formed flowing the electric current through the electrolyte and the wheel typically has a conductivity that results in a 7 volt to 10 volt voltage drop in the current flowing into and out of the current source. If the voltage drop increases beyond 10 volts, additional TSP is dissolved into the TSP electrolyte to return the voltage drop to the 7 volt to 10 volt voltage drop range. When cleaning truck wheels in a tank holding 65 gallons of TSP electrolyte, it has been found that one pound of TSP is typically added to the TSP electrolyte for every 5 or 6 wheels being cleaned to maintain the desired pH and conductivity of the TSP electrolyte.

The current source 22 is then shut off after five minutes and the wheel 10 is removed from the TSP electrolyte 12.

The TSP electrolyte 12 can be filtered to remove solid particulates and other solid contaminants. Water can be added to the TSP electrolyte to replace water lost by evaporation or by adhering to bodies removed from the TSP electrolyte.

The wheel 10 being cleaned as illustrated in FIG. 1 is wetted by immersion into the TSP electrolyte 12. In alternative embodiments of the disclosed method the wheel 10 is wetted by the TSP electrolyte by being sprayed with the electrolyte. Immersion is generally preferred because it is easier to maintain the desired temperature of the TSP electrolyte when in contact with the wheel during electrolysis.

After the wheel 10 has been exposed to the DC current a sufficient time for cleaning, the wheel is removed from the TSP electrolyte 12. The surface of the wheel 10 after removal is clean and has a commercially acceptable brightness. However, there may be loose scale, dirt, or the like on the wheel that can be easily removed using an additional cleaning step.

The additional cleaning step may be an ultrasonic cleaning step. Ultrasonic cleaning involves immersing the wheel 10 in a liquid in which high frequency sound waves agitate the liquid for cleaning.

Ultrasonic cleaning is itself conventional and so will not be described in further detail. The inventors have found that ultrasonic cleaning at a 25 kHz frequency has provided good results for removing loose dirt, scale, or the like from the wheel 10. It should be noted that ultrasonic cleaning alone of a dirty aluminum truck wheel 10 did not satisfactorily clean or brighten the wheel.

The ultrasonic cleaning liquid may be an aqueous solution containing a cleanser compatible with aluminum. Examples of ultrasonic cleansers for cleaning aluminum that can be adapted for use with the disclosed method include TRANSBRITE™ ultrasonic cleaning liquid solution distributed by Allen Woods & Associates, Arlington Heights, Ill., PELCO KLEENSONIC™ CDC ultrasonic cleaning solution distributed by Ted Pella, Inc., Redding, Calif. 96049, and equivalents. The cleanser may help brighten an already clean aluminum truck wheel but the inventors have found the cleanser does not need to be relied on or used for achieving a commercially acceptable brightness of an aluminum truck wheel.

In alternative embodiments of the disclosed method the additional cleaning step can be eliminated or replaced with another cleaning method, such as power washing, that is, rinsing the body with a pressurized water spray.

After electrolysis and any additional cleaning step, the cleaning the wheel 10 is dried. The wheel 10 may then be powder coated or otherwise coated or painted for recycling, return to the aftermarket, or reuse.

In alternative embodiments of the disclosed method, some, but not all, surfaces of the metal or metal alloy body require cleaning. In such embodiments, the body may only be partially immersed in the TSP electrolyte 12 or wetted by the electrolyte to wet only the desired surfaces to be cleaned.

In yet other embodiments of the disclosed TSP electrolyte, the weight percent of TSP can be more or less than fifteen percent for lighter duty cleaning or heavier duty cleaning.

In yet additional embodiments of the disclosed TSP electrolyte, the electrolyte may contain additional ingredients that do not substantially change the operation of the TSP electrolyte as a conductor with respect to the metal body being cleaned, or do not add ions to the electrolyte. The TSP dissolved in the electrolyte should be sufficient to generate a pH of between about 10 and 10.5 independently of any ions provided by any additional ingredients. The additional ingredients may be coatings that provide additional benefits or features such as, in a non-limiting example, a post-wash film that inhibits corrosion or adherence of contaminants to aluminum surfaces.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, operating ranges (temperature, volume, displacement, stroke length, concentration, and the like), and environment of use.

What is claimed is:

1. A method for electrolytic cleaning of an aluminum or aluminum alloy body, the method comprising the steps of:

(a) providing an aqueous electrolyte, an electrically conductive ferrous electrode, and an electrical current source having a positive terminal and a negative terminal, the electrolyte comprising trisodium phosphate dissolved in water, the electrolyte having a pH generated by the dissolved trisodium phosphate in the water of between about 10 and about 10.5, the electrode being wetted by the electrolyte and being electrically connected to the positive terminal of the electrical current source;

(b) electrically connecting the body with the negative terminal of the electrical current source and wetting the body with the electrolyte, the electrolyte electrically connecting the body and the wetted electrode;

(c) flowing electrical current from the electrical current source through the wetted electrode, the electrolyte, and the wetted body concurrently with step (a); and (d) stopping the flow of the electrical current after performing step (c).

2. The method for cleaning of claim 1 wherein the electrolyte consists solely of water and dissolved trisodium phosphate.

3. The method for cleaning of claim 1 wherein the electrolyte includes one or more additional materials mixed into the electrolyte that do not substantially alter the pH of the electrolyte.

4. The method for cleaning of claim 1 comprising the step of:

(e) maintaining the electrolyte at a temperature of between about 150 degrees Fahrenheit (66 degrees Celsius) and the boiling point of the electrolyte while performing step (c).

5. The method for cleaning of claim 4 wherein step (e) comprises the step of maintaining the electrolyte at a temperature of between about 180 degrees Fahrenheit (82 degrees Celsius) and about 190 degrees Fahrenheit (88 degrees Celsius) while performing step (c).

6. The method for cleaning of claim 1 wherein step (c) comprises the step of flowing DC current for about 5 minutes.

7. The method for cleaning of claim 1 wherein step (b) comprises immersing the body into the electrolyte.

8. The method for cleaning of claim 1 wherein step (b) comprises spraying the electrolyte onto the body.

9. The method for cleaning of claim 1 wherein the electrolyte comprises about 15 weight percent of dissolved trisodium phosphate to the weight of the water.

10. The method for cleaning of claim 1 comprising the step of performing an additional cleaning step on the body after performing step (d).

11. The method for cleaning of claim 10 wherein the additional cleaning step comprises ultrasonic cleaning of the body or power washing of the body.

12. The method for cleaning of claim 11 wherein the additional cleaning step comprises ultrasonic cleaning at a 25 kHz frequency.

13. The method for cleaning of claim 1 wherein step (c) comprises flowing DC current.

14. The method for cleaning of claim 13 wherein step (c) comprises flowing at least a 1000 ampere current.

15. The method for cleaning of claim 1 wherein step (c) comprises generating a voltage drop of between about 5 volts and about 10 volts in the electrical current flowing from the current source, through the body, and back to the current source.

16. The method for cleaning of claim 1 including the step of dissolving additional trisodium phosphate in the electrolyte to maintain the pH of the electrolyte between about 10 and about 10.5.

17. The method for cleaning of claim 1 wherein the body is a wheel or rim for a motor vehicle, the electrolyte is maintained at a temperature of not less than 150 degrees Fahrenheit (66 degrees Celsius) while performing the method, and step (c) comprises flowing between about 500 amperes and about 1250 amperes of DC current through the body.

18. The method for cleaning of claim 1 wherein the electrode is a steel electrode.

* * * * *